US006002649A

United States Patent [19]

Janus

[11] Patent Number: 6,002,649

[45] Date of Patent: Dec. 14, 1999

[54] TAPERED CYLINDER ELECTRO-ACOUSTIC TRANSDUCER WITH REVERSED TAPERED DRIVER

[75] Inventor: Robert S. Janus, Quaker Hill, Conn.

[73] Assignee: The United States of America as represented by the Secretary of the Navy, Washington, D.C.

[21] Appl. No.: 08/933,611

[22] Filed: Sep. 16, 1997

[51] Int. Cl.[6] ..... H04R 23/00

[52] U.S. Cl. ..... 367/162; 367/163; 367/160

[58] Field of Search ..... 367/160, 162, 367/163, 174, 176; 310/321, 322, 323, 324, 330, 369

[56] References Cited

U.S. PATENT DOCUMENTS

| | | | |
|---|---|---|---|
| 4,682,070 | 7/1987 | Plambeck | 367/912 |
| 4,774,427 | 9/1988 | Plambeck | 310/321 |
| 4,788,467 | 11/1988 | Plambeck | 310/323 |
| 5,450,373 | 9/1995 | Kupiszewski et al. | 367/162 |

*Primary Examiner*—Daniel T. Pihulic
*Attorney, Agent, or Firm*—Michael J. McGowan; Robert W. Gauthier; Prithvi C. LAll

[57] ABSTRACT

A slotted cylinder transducer is provided having a cylindrical metal or composite material shell. A cylindrical piezoelectric driver is bonded to the inside of the shell with an opening corresponding to the slot. The shell thickness is tapered radially about the longitudinal axis such that the thickness is a maximum 180° away from the slot and decreases progressively to a minimum adjacent each side of the slot. The piezoelectric driver is reverse tapered from the shell taper in that the thickness of the driver is a minimum 180° away from the slot and increases progressively to a maximum adjacent each side of the slot. This taper places a larger volume of the driver material in the slot region of the shell where the maximum radial displacements occur, thus providing higher acoustic energy levels. When used as a hydrophone to detect acoustic signals in the surrounding medium, the larger volume of material at the point of maximum displacement provides increased signal detection capability.

12 Claims, 2 Drawing Sheets

TAPERED CYLINDER ELECTRO-ACOUSTIC TRANSDUCER WITH REVERSED TAPERED DRIVER

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates generally to transducers, and more particularly to slotted cylinder transducers having a cylindrical piezoelectric driver element bonded to the inside of a cylindrical shell and having a slot cut along the length of the shell and the driver element.

(2) Description of the Prior Art

Transducers are used in the generation and reception of underwater sound. A typical configuration of a slotted cylinder transducer would have the acoustically active component, or electromechanical driver, located in the interior cavity of a cylindrical shell. The shell would be fabricated of a metal or a laminated composite material. The driver is commonly a cylinder or set of rings of piezoelectric material that is mechanically connected to the cylindrical shell by means of an epoxy bond between the outer surface of the driver and the inner surface of the shell. The driver rings, or cylinder, are frequently constructed of an assembly of segmented pieces which are cemented together and electrically connected via foil electrodes located in the joints between adjacent segments. The curvature of the cylindrical shell places a residual compressive stress on the driver. This compressive stress on the driver must be maintained to prevent the driver from undergoing tensile strain which would cause the piezoelectric driver material to fracture. The driver receives additional compressive stress from increased hydrostatic pressure as the transducer is used in underwater operations.

A slot extending the length of the cylinder and parallel with the cylindrical axis is cut through the wall of the shell and also through the driver. Inserts or end shanks are bonded to the interior surface of the shell adjacent slot and to the ends of the piezoelectric element. When the driver is excited with an alternating electrical signal, the circumference of the driver will expand and contract against the inserts, creating flexural vibration in the cylindrical shell. The fundamental mode of this vibration consists of a nodal region of minimal or no radial displacement, located 180° from the slot. In this mode, the radial displacement of the cylindrical shell increases in magnitude from a minimum in the nodal region to a maximum near the slot. The motion of the shell can be likened to a conventional tuning fork whose tines have been bent into a circular shape. The radial displacement of the cylindrical shell radiates acoustic energy into the medium surrounding the transducer. The transducer can also be used as a hydrophone by detecting acoustic vibrations in the medium that excite mechanical vibrations in the cylindrical shell, which in turn generate an electrical signal in the driver material.

To increase the level of acoustic energy radiated by the transducer, the wall thickness of the cylindrical shell can be tapered having its thickest point at the nodal region and becoming progressively thinner towards the slot. Such a tapered shell is disclosed in U.S. Pat. No. 4,774,427 to Plambeck. Some transducer applications, such as those requiring the acoustic signal to travel long distances, require further increases in radiated energy. Additionally, increased detection capabilities are required for transducers used as hydrophones to receive such long distance signals.

SUMMARY OF THE INVENTION

Accordingly, it is an object of the present invention to provide a slotted cylindrical transducer with an increased radiated energy compared to current slotted cylindrical transducers of similar size.

Another object of the present invention is to provide a slotted cylindrical transducer which, when used to receive an acoustic signal, has an increased acoustic signal detection capability compared to current slotted cylindrical transducers of similar size.

Other objects and advantages of the present invention will become more obvious hereinafter in the specification and drawings.

In accordance with the present invention, a transducer has a cylindrical metal or composite material shell. A cylindrical piezoelectric driver is bonded to the inside of the shell and a slot is cut along the length of the shell and driver, parallel with the longitudinal axis of the shell and bonded driver. The shell thickness is tapered radially about the longitudinal axis such that the thickness is a maximum 180° away from the slot and decreases progressively to a minimum adjacent each side of the slot. The piezoelectric driver is reverse tapered from the shell taper in that the thickness of the driver is a minimum 180° away from the slot and increases progressively to a maximum adjacent each side of the slot. This taper places a larger volume of the driver material in the slot region of the shell where the maximum radial displacements occur. By distributing the driver material in this inverse tapered configuration, higher acoustic energy levels can be generated than can be obtained with current slotted cylindrical shell transducers of similar size. When used as a hydrophone to detect acoustic signals in the surrounding medium, the larger volume of material at the point of maximum displacement provides increased signal detection capability.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENT

Figure 1:
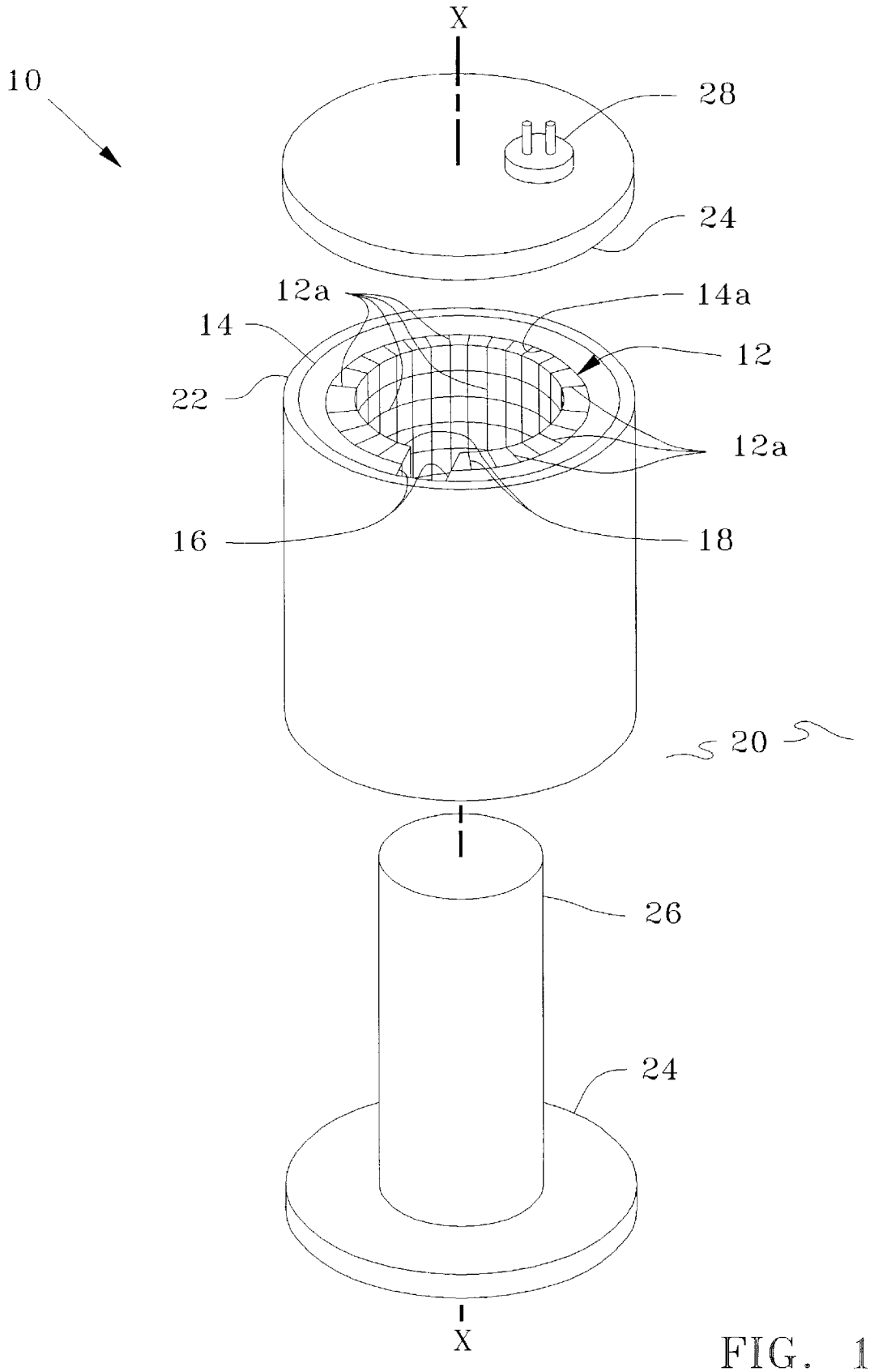
FIG. 1 is an exploded view of the transducer of the present invention.
Figure 2:
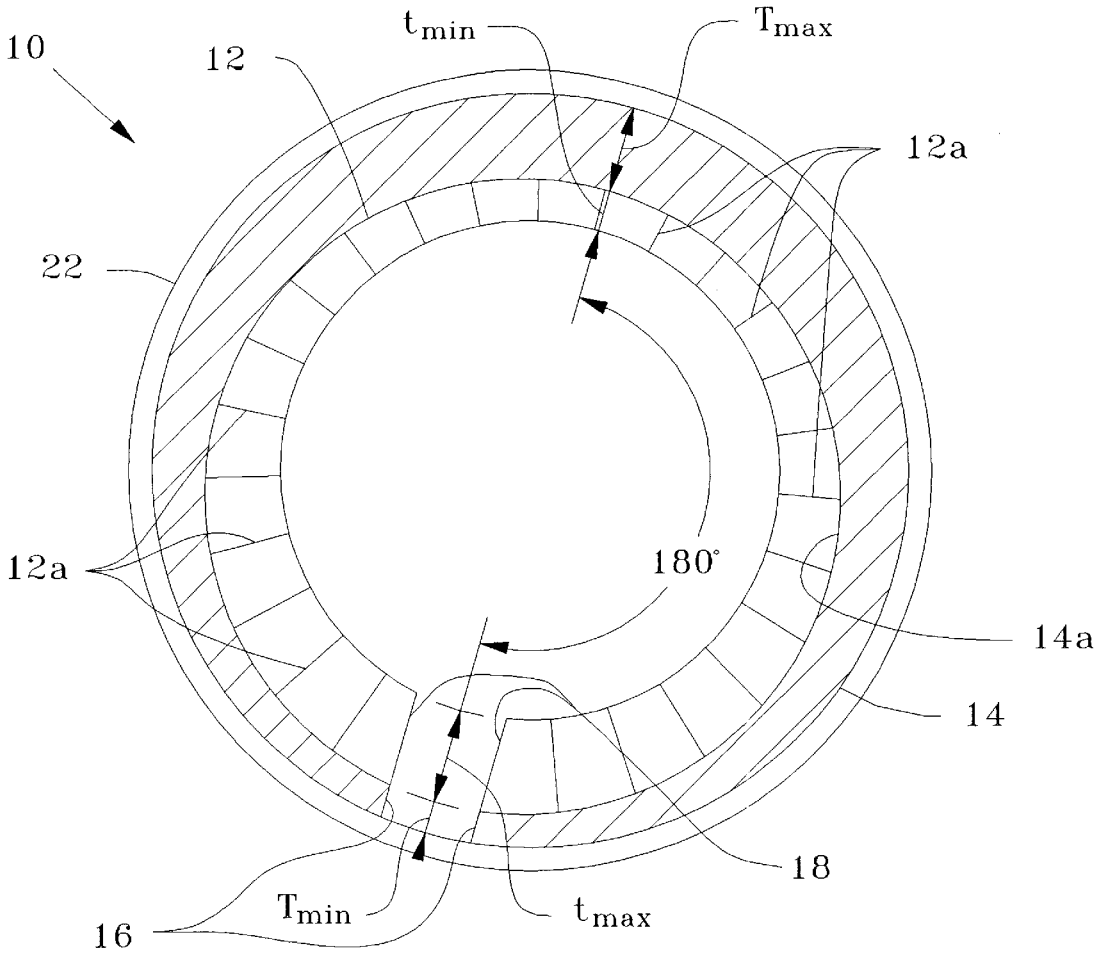
FIG. 2 is a cross section of the transducer of the present invention.

Referring now to FIGS. 1 and 2, there is shown an exploded view of transducer 10 at FIG. 1 and a cross section of transducer 10 at FIG. 2. A piezoelectric driver element 12 is located in the interior cavity of a cylindrical shell 14. Shell 14 is fabricated of a metal or a laminated composite material. Driver element 12 is mechanically connected to cylindrical shell 14 by means of an epoxy bond (not shown)

between the outer surface of the driver element 12 and the inner surface of the shell 14. The driver element 12 is constructed of an assembly of segmented pieces (a number of which have been denoted as 12*a* in FIGS. 1 and 2) cemented together and electrically connected to form cylindrical piezoelectric element 12 generally conforming to cylindrical shell 14. A slot 16 is cut along the length of shell 14 and piezoelectric element 12, parallel to the longitudinal axis X—X of shell 14 and element 12. Inserts 18 are adhesively bonded to the interior surface 14*a* of shell 14 at the edges of slot 16 and also bonded to the adjacent ends 12*b* of piezoelectric element 12. As has been done in the prior art, shell 14 decreases in thickness from a maximum $T_{max}$ at a point 180° from slot 16 to a minimum $T_{min}$ adjacent to slot 16. The thickness of piezoelectric element 12 has a reverse taper in that piezoelectric element 12 increases in thickness from a minimum $t_{min}$ at a point 180° from slot 16 to a maximum $t_{max}$ adjacent slot 16. To isolate piezoelectric element 12 and the interior of shell 14 from the surrounding medium 20, shell 14 is encased in an elastomer material, or rubber boot 22. Covers 24 are provided to seal the ends of shell 14. A post 26 extends between and is attached to covers 24 by any suitable means such as screw threads, or the like. When assembled, post 26 serves to maintain a slight separation between covers 24 and shell 14 such that covers 24 do not constrain the radial displacement of shell 14. When assembled, boot 22 extends over and is sealed to covers 24 such that piezoelectric element 12 and the interior of shell 14 are not exposed to medium 20. Electrical power is supplied to piezoelectric element 12 via waterproof, underwater cable connector 28 which penetrates one of the covers 24.

Referring now particularly to FIG. 2, transducer 10 is shown in cross section to better illustrate the inverse tapers of shell 14 and piezoelectric element 12 and their relation to slot 16. As in FIG. 1, piezoelectric element 12 is seen to be composed of segmented pieces 12*a* cemented together and electrically connected to each other and further held within shell 14 by inserts 18.

In operation, when transducer 10 is excited with an alternating electrical signal, piezoelectric element 12 expands and contracts in response to the signal as is well known in the art. The expansion and contraction of piezoelectric element 12 against and from inserts 18 results in radial displacement of shell 14 in the vicinity of slot 16. This displacement, or flexural vibration corresponding to the expansion and contraction of piezoelectric element 12, generates the acoustic signal. The additional thickness of piezoelectric material adjacent slot 16 causes the expansion and contraction of piezoelectric element 12 to be greatest in this area, thus accentuating and increasing the flexural vibration of shell 14 in the area of slot 16. The increased flexural vibration results in an increase in the energy level of the acoustic signal. When transducer 10 is used as a hydrophone to detect acoustic vibrations in medium 20, the increased thickness of piezoelectric element 12 in the region of slot 16 generates a stronger signal for a given deflection of shell 14 compared to a thinner piezoelectric element. Although more driver mass is being added to the region of highest radial displacement, properly adjusting the taper of both the shell 14 and piezoelectric element 12 will produce the desired enhanced vibration.

The invention thus described provides a slotted cylinder transducer with an increased acoustic signal energy level when compared to prior art transducers having constant thickness piezoelectric elements or piezoelectric elements having a maximum thickness in the region 180° from the slot. The invention also provides a hydrophone which is more sensitive to acoustic vibrations than prior art hydrophones.

Although the present invention has been described relative to a specific embodiment thereof, it is not so limited. For example, the driver may be a relaxor ferroelectric material such as lead-magnesium-niobate in lieu of the piezoelectric ceramic described. Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A transducer assembly comprising:

a generally cylindrical shell having a first axially extending opening and having increasing thickness with increasing distance from the first opening; and a generally cylindrical driver element encased within and bonded to the shell, the driver element having a second axially extending opening corresponding to the first axially extending opening of the shell and having decreasing thickness with increasing distance from the second opening, the driver element expanding and contracting in response to an alternating electrical signal to produce acoustical energy.

2. The transducer assembly of claim 1 wherein the driver element is formed of separate segments electrically bonded together.

3. The transducer assembly of claim 1 further comprising a boot encasing the shell and driver element to isolate the driver element from a medium surrounding the transducer assembly.

4. The transducer assembly of claim 3 wherein the boot further comprises top and bottom covers forming a seal at respective ends of the generally cylindrical shell.

5. The transducer assembly of claim 4 wherein the top and bottom covers further comprise a rod extending axially through the generally cylindrical driver element and connecting the top and bottom covers, the rod maintaining a separation between the top and bottom covers and the respective ends of the shell, the separation allowing unimpeded flexure of the shell.

6. The transducer assembly of claim 1 wherein the shell is a metal.

7. The transducer assembly of claim 1 wherein the shell is a composite material.

8. The transducer assembly of claim 1 wherein the driver element is a piezoelectric ceramic.

9. The transducer assembly of claim 1 wherein the driver element is a relaxor ferroelectric material.

10. The transducer assembly of claim 9 wherein the relaxor ferroelectric material is lead-magnesium-niobate.

11. The transducer of claim 1 further comprising a pair of inserts bonded to an interior surface of the shell, the pair of inserts disposed to either side of the opening adjacent the driver element, the expansion and contraction of the driver element being transferred from the driver element through the inserts to the shell.

12. The transducer of claim 2 further comprising a pair of inserts bonded to an interior surface of the shell, the pair of inserts disposed to either side of the opening adjacent the driver element, the expansion and contraction of the driver element being transferred from the driver element through the inserts to the shell.

* * * * *